US005386713A

United States Patent [19]

Wilson

[11] Patent Number: 5,386,713

[45] Date of Patent: Feb. 7, 1995

[54] REMOTE CONTROL CAR DEADBOLT LOCK

[76] Inventor: Bert Wilson, 400 Lake St., #209, Huntington Beach, Calif. 92648

[21] Appl. No.: 81,886

[22] Filed: Feb. 4, 1993

Related U.S. Application Data

[63] Continuation of Ser. No. 667,600, Mar. 7, 1991, abandoned.

[51] Int. Cl.[6] ..... E05B 47/06

[52] U.S. Cl. ..... 70/280; 70/277; 70/128; 70/257; 292/144; 292/61

[58] Field of Search ..... 70/102, 117, 128, 277–278, 70/279, 280–283, 221, 451, 264; 292/257, DIG. 4, 201, 144, 336.3, 61

[56] References Cited

U.S. PATENT DOCUMENTS

| | | | |
|---|---|---|---|
| 2,016,196 | 10/1935 | Handfield | 292/61 |
| 2,078,248 | 4/1937 | Holtzman | 70/117 |
| 2,763,888 | 9/1956 | Billeter | 292/144 |
| 2,765,648 | 10/1956 | Hatcher | 70/264 |
| 3,152,822 | 10/1964 | Griffiths | 292/61 |
| 3,564,501 | 2/1971 | Flook, Jr. | 340/825.31 |
| 3,760,422 | 9/1973 | Zimmer et al. | 343/225 |
| 3,830,332 | 8/1974 | Fontaine | 70/257 |
| 3,906,348 | 9/1975 | Willmott | 340/147 R |
| 3,924,427 | 11/1975 | San Juaquin | 70/264 |
| 4,083,424 | 4/1978 | von den Stemmen et al. | 70/278 |
| 4,203,039 | 5/1980 | Pritchard | 70/279 |
| 4,249,761 | 2/1981 | Nishimura | 292/DIG. 4 |
| 4,258,352 | 3/1981 | Lepschutz | 340/53 |
| 4,372,419 | 2/1983 | Barnett et al. | 70/279 |
| 4,700,801 | 10/1987 | Ailing | 70/237 |
| 4,702,095 | 10/1987 | Ben-Asher | 70/128 |
| 4,784,415 | 11/1988 | Malaval | 70/282 |
| 4,794,268 | 12/1988 | Nakano et al. | 70/257 |
| 5,037,145 | 8/1991 | Wilkes | 292/336.3 |

*Primary Examiner*—Peter M. Cuomo
*Assistant Examiner*—Darnell M. Boucher
*Attorney, Agent, or Firm*—Baker & Botts

[57] ABSTRACT

A remote control car deadbolt lock includes a lock housing (14) mountable between a car door and car door facing which includes a locking mechanism (24). Receiver assembly (12) mounts within the car door or door facing opposite the lock housing. Locking mechanism (24) includes deadbolt (26) which mounts to reciprocate between a locked position (34) and unlocked position (106). Locking mechanism (24) also includes solenoid (60) and spring actuator comprising spring (44), cam (46) and select mechanism (52). Solenoid (60) causes deadbolt (26) to reciprocate in response to an electrical signal. Spring actuator (25) controls the locked and unlocked position of deadbolt (26). Receiver assembly (12) receives deadbolt (26) when deadbolt (26) is in locked position (34), thereby causing deadbolt (26) to lock car door to car door facing. A remote actuator, in the preferred embodiment, includes a transmitter (108) and receiver (112) for remote control of locking mechanism (24).

15 Claims, 4 Drawing Sheets

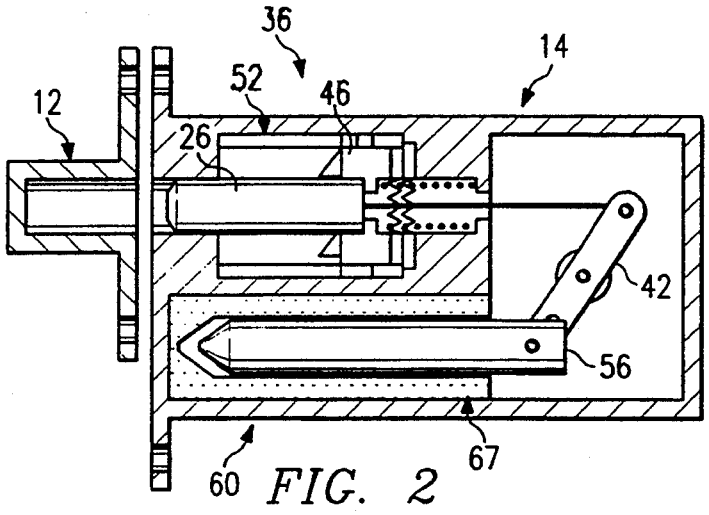
FIG. 2
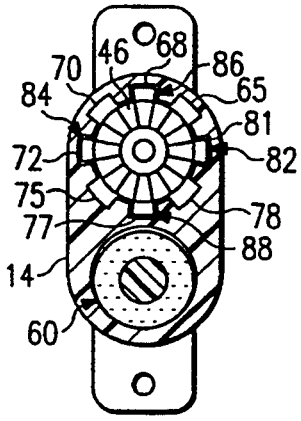
FIG. 5
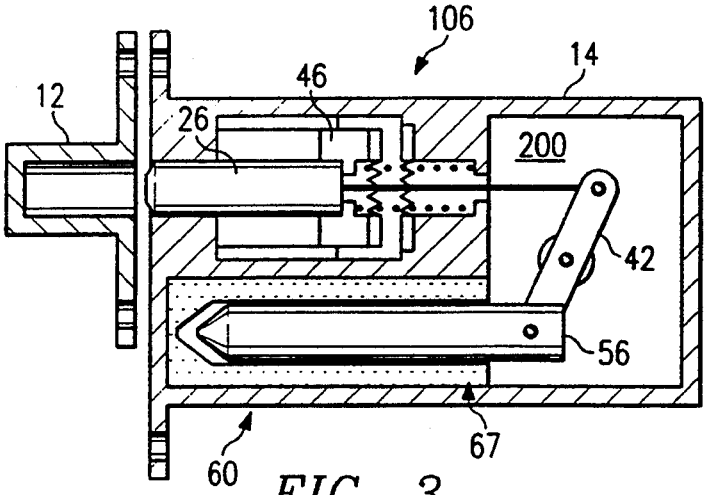
FIG. 3
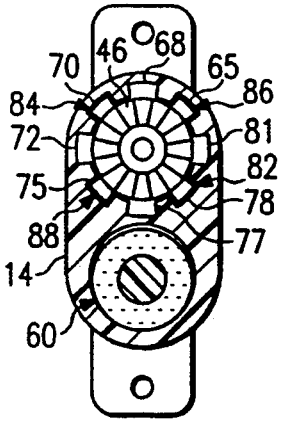
FIG. 6
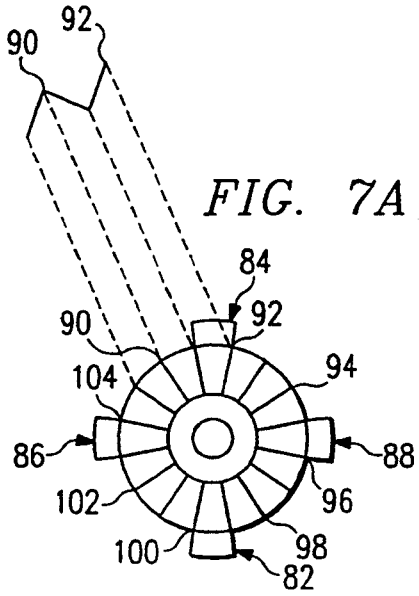
FIG. 7A
FIG. 7B
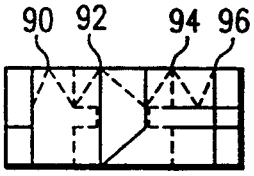

REMOTE CONTROL CAR DEADBOLT LOCK

CROSS REFERENCE TO RELATED APPLICATIONS

This application is a continuation of application Ser. No. 07/667,600 filed Mar. 7, 1991, entitled "Remote Control Car Deadbolt Lock" by Bert Wilson, now abandoned.

TECHNICAL FIELD OF THE INVENTION

This invention relates in general to the securing mechanisms for automobiles and more particularly to a remote control automobile deadbolt lock for locking a car door.

BACKGROUND OF THE INVENTION

Over the years, incidents of car theft have grown. Although most car manufacturers have made some strides in making cars more "thief proof," current locking mechanisms suffer from several limitations. In particular, known locking mechanisms are mechanically linked to the portion of the car door that operates when the door is opened without being locked. Current car door locks operate by turning a key which mechanically actuates the locking mechanism. The locking mechanism is linked to the door opening mechanism so that the door lock prevents operation of the opening mechanism. Unlocking the door allows the opening mechanism to operate. By using a bent coat hanger or a "slim jim", which is a flat piece of metal with a notch in the bottom, a thief can override the known types of car door locks to open a car door as quickly as can be done using a key. Because known car door locks are tied to the door operating means, the way to unlock a car door to steal the car are always accessible, at least to some degree, to a potential thief.

One way to overcome at least a portion of the above problem has been to remove from the car door the key mechanism for operating the door lock. A popular way to do this has been to provide to the user a remote control car door key. With such a device, the user retains in his possession the linkage that usually exists between the key and the locking mechanism. Aftermarket vehicle security devices are available that allow the owner to remotely open or close the lock, but these may still be overridden by using a "slim jim" or other means to actuate the locking mechanism. This is due to the fact that even with the remote control devices, the mechanical linkage between the door key and lock mechanism and the operating mechanism still exists.

Thus, there is a need for an effective convenient door lock that does not use a mechanical mechanism or linkage between the door key and the door opening mechanism.

There is a need for a car door lock that removes any linkage between the locking mechanism and the door opening mechanism.

There is the need for a car door lock that cannot be overridden by a "slim jim" or other device.

Moreover, there is a need for a device that a car owner can use to lock his car door so that only the user has the ability to open the car door and for which the means to open the car door are not easily accessible on the door.

SUMMARY OF THE INVENTION

The present invention solves problems posed by known or proposed car door locks by, among other things, effectively locking the door without a mechanical linkage between the door key and the locking mechanism and without a mechanical linkage between the locking mechanism and the opening mechanism.

According to the invention, there is provided a car deadbolt lock for locking the car door that comprises a lock housing mountable within a car door or car door facing. A locking mechanism within the lock housing comprises a deadbolt and deadbolt carrier. The deadbolt and carrier are mounted to reciprocate between a locked position and an unlocked position. The locking mechanism further comprises a solenoid and a spring actuator. The solenoid causes the reciprocation of the deadbolt in response to an electrical signal. The spring actuator controls the locked and unlocked condition of the lock. The car deadbolt lock also includes a receiver assembly that mounts within the car door facing or car door to receive the deadbolt when the deadbolt is in the locked position. This causes the deadbolt to lock the car door to the facing. Circuitry within an alarm assembly connects to the remote car deadbolt lock to direct electrical signals to the solenoid.

The result of the present invention is a remote control car deadbolt lock that permits the user to lock the car door while retaining within his control at all times the means by which to activate the car door lock. Moreover, the present invention prevents an intruder from mechanically opening the car door, because there is no mechanical linkage between the car door locking mechanism and the opening mechanism.

Other advantages of the present invention will become apparent in the drawings and detailed description which follow below.

BRIEF DESCRIPTION OF THE DRAWINGS

The invention will be clearly understood on reading of the following description given with reference to the accompanying drawing, wherein:

FIGS. 1 through 3 illustrate cut-away schematic views of the preferred embodiment of the present invention showing the locked, intermediate, and unlocked positions, respectively;

FIGS. 4 through 6 show the locking mechanism along the cross-sectional lines A—A in FIGS. 1 through 3, respectively;

FIGS. 7A and 7B illustrate the configuration of the cam mechanism of a preferred embodiment of the present invention;

DETAILED DESCRIPTION OF THE INVENTION

For a more complete understanding of the present invention and for further advantages thereof, reference is now made to the following detailed description, taken in conjunction with the accompanying Figures.

Structure of the Preferred Embodiment

Figure 1:
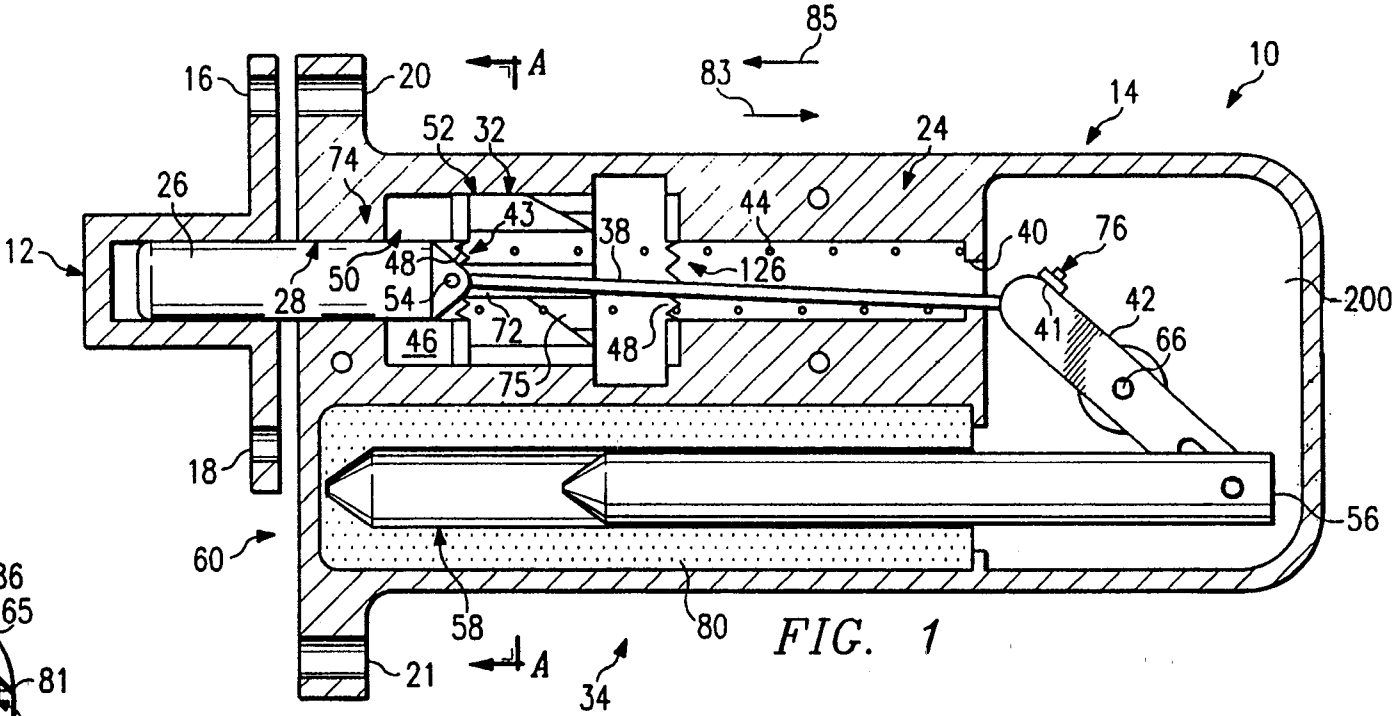
Figure 4:
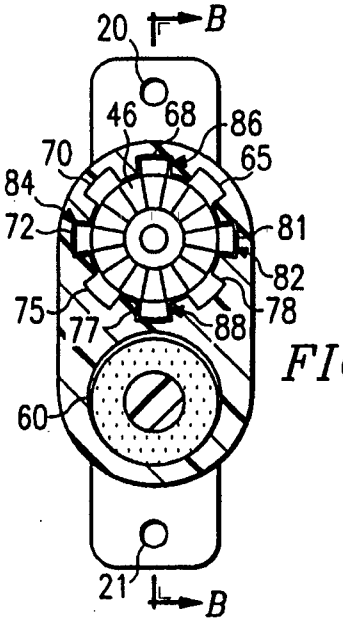
Figure 8:
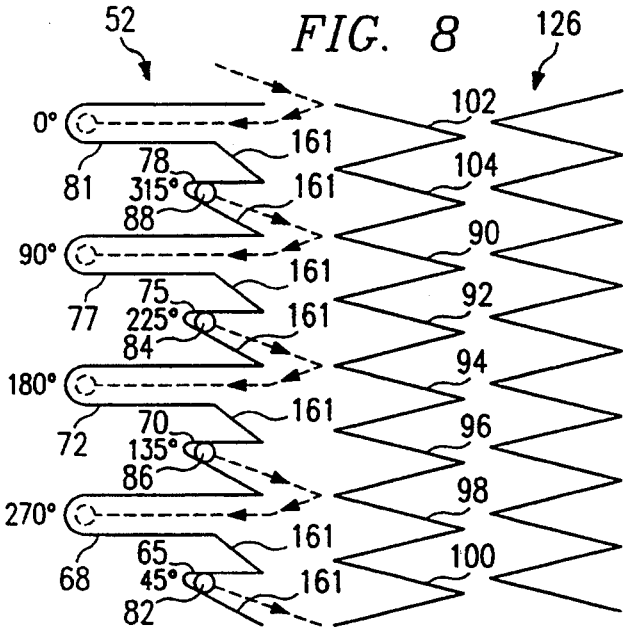
FIG. 8 shows a flat projection of the ratcheting action of the cylindrical select mechanism of the preferred embodiment.

FIGS. 1 through 3 provide cut-away side schematic views of the preferred embodiment of a car door lock 10 in the locked, intermediate and unlocked positions. FIGS. 4 through 6 show end views of the preferred embodiment that correspond to the cut-away side views of FIGS. 1 through 3. FIG. 8 shows the effect of the movements of FIGS. 1 through 3 on the rotational position of the locking mechanism of the preferred embodiment. FIGS. 7A and 7B more specifically show components in the preferred embodiment that permit rotational position changes. In the preferred embodiment, receiver assembly 12 may mount within a car door or car door facing. Lock housing 14 may mount opposite the receiver in either the facing or door, as appropriate. Receiver assembly 12 allows the use of screws for attachment through screw holes 16 and 18. Similarly, lock housing 14 permits using similar fasteners through screw holes 20 and 21. Lock housing 14 encases a locking mechanism 24 that includes select mechanism 52 which is molded into the lock housing 14, bolt carrier assembly 74, and solenoid assembly 60.

Locking mechanism 24 includes bolt carrier assembly 74 which slides within lockbore 28 and bolt carrier pathway 32, both of which are molded into housing 14. Deadbolt 26 engages receiver assembly 12. The bolt carrier assembly 74 consists of deadbolt 26 which fits into counterbore 50 of cam 46 of FIG. 1. Bolt carrier assembly 74 slides within bolt carrier pathway 32 from locked position 34 (FIG. 1) to intermediate position 36 (FIG. 2). Cable 38 attaches to deadbolt 26, passes through cable bore 40, and connects to lever 42. Locking mechanism 24 also includes solenoid 60 and spring actuator 43 comprising spring 44, cam 46 and select mechanism 52. Compression spring 44 rests between counter bore 48, which is part of housing 14. The compression spring 44 exerts a spring force directing bolt carrier assembly 74 in the direction of the receiver assembly 12. Bolt carrier assembly 74 combines deadbolt 26 and cam 46 into a single moving piece. Counter-bore 48 within cam 46 and locking mechanism 24 receives spring 44. Counter-bore 50 of cam 46 firmly holds deadbolt 26 and causes deadbolt 26 to move as cam 46 moves.

Cable 38 connects to the solenoid assembly 60. Solenoid assembly 60 rests within a pocket 200 molded into housing 14 and consists of coil 80 that provides electromagnetic force and solenoid barrel 58 in which stem 56 moves in a reciprocating manner. Solenoid 60 is a pull solenoid which pulls stem 56 into barrel 58 when coil 80 is energized. Stem 56 attaches to lever 42 of pivot assembly 76 to provide a force to counteract spring 44 and pull bolt carrier assembly 74 away from receiver assembly 12.

Locking mechanism 24 also includes select mechanism 52 which is molded into housing 14 within bolt carrier pathway 32.

FIG. 8 illustrates select mechanism 52, which includes a series of locking notches 65, 70, 75 and 78 and full-length grooves 68, 72, 77 and 81 which engage and cause cam 46 to rotate one-eighth of a complete revolution each time the deadbolt 26 is actuated by solenoid 60. Since cam 46 rotates, either the point 54 at which cable 38 connects to deadbolt 26 or point 41 at which cable 38 connects to lever 42 must swivel to allow 360° rotation about the tip of the cable 38 without twisting cable 38. Lever 42 pivotally attaches to pivot point 66 and to solenoid stem 56. Solenoid stem 56 reciprocally mounts within solenoid barrel 58. Solenoid barrel 58 and stem 56 are part of solenoid 60. This allows bolt carrier assembly 74 to cycle from locked position 34 to intermediate position 36 from the pull of solenoid 60 and then into unlocked position 106 from the push of spring 44. The switching action provided by saw tooth notches 90–104, when viewed as a cylinder, causes bolt carrier assembly 74 to rotate one-sixteenth of a complete revolution each time solenoid 60 is actuated, causing solenoid force 83. This moves bolt carrier assembly to intermediate position 36.

Spring 44 then provides spring force 85 to cause bolt carrier assembly 74 to rotate another one-sixteenth turn as cam 46 engages the unlocking notches 65, 70, 75 and 78. This causes bolt carrier assembly 74 to remain in unlocked position 106.

The next time solenoid 60 is actuated, the procedure is similar with bolt carrier assembly 74 rotating from unlocked position 106 to intermediate position 36 with a one-sixteenth turn, followed by the pressure caused by spring 44 which causes another one-sixteenth turn as cam 46 engages the full-length grooves 68, 72, 77 and 81. This causes bolt carrier assembly 74 to remain in locked position 34.

Receiver assembly 12 provides an environmental enclosure for receiving deadbolt 26 as well as increases the security of the deadbolt. Although sheet metal found in most car doors or door facings can provide sufficient strength to receive and hold deadbolt 26 in place, receiver assembly 12 is designed to maintain the closure of car deadbolt lock 10. This prevents a potential intruder from tampering with deadbolt 26 when it is in the locked position. Receiver assembly 12, in the preferred embodiment comprises a Torlon or a plastic material having a tensile strength of approximately 23,000 psi.

Lock housing 14 comprises a light, high tensile plastic cover, in the preferred embodiment, and includes no mechanical connection to the car door key mechanism or other mechanical portion of car door. Lock housing 14 prevents access to the lock mechanism 24 without complete disassembly of the car door and deadbolt lock 10.

Most materials within car deadbolt lock 10 may be made of 7130 grade Torlon or a high strength plastic except for deadbolt 26, spring 44 and solenoid 60. Torlon is a composite material comprising 30% graphite fiber, 1% fluorocarbon, and 69% polymer resin. The preferred embodiment uses a grade 7130 Torlon manufactured by Amoco Company of Atlanta, Ga. Deadbolt 26 may comprise a plastic, metal, or composite material sufficiently strong to prevent a potential intruder from a successful attempt to open the door. Deadbolt 26, in the preferred embodiment, is a 303 stainless steel having a diameter of approximately $\frac{1}{4}''$. This material provides sufficient strength for purposes of the present invention.

Locking mechanism 24 is a simple, highly reliable device containing few moving parts. As a result, failure of locking mechanism 24 is minimized. Bolt carrier assembly 74 in the preferred embodiment, comprises a low friction material, such as Torlon 7130, polyethylene or other low friction material to facilitate bolt carrier assembly 74 movement within locking mechanism 24. Spring 44 is a resilient metal spring that provides a compressive spring force against bolt carrier assembly 74. Cable 38 may comprise a stainless steel or other material having sufficiently strong tensile strength to cause bolt carrier assembly 74 to move in response to movement of lever 42.

Spring 44 may be made of any material having sufficient strength to cause operation of locking mechanism 24 as described below. In the preferred embodiment, spring 44 comprises a stainless steel spring No. TT-68 manufactured by Century Spring Company. Cable 38 may be of any material having sufficient strength to overcome the spring force of spring 44 and solenoid 60. Lever 42 may be composed of a Torlon or a high strength plastic material and die cast or injection molded, in the same tooling along with receiver assembly and other components of locking mechanism 24. In the preferred embodiment, pivot point 66 is a boss which comprises part of and may be die cast simultaneously with locking housing 14. The size of space 90 for movement for solenoid stem 56 is limited to the space necessary for movement of lever 42 as it rotates at pivot point 66 and for solenoid stem 56 to enter and exit solenoid barrel 58.

Solenoid 60 is a tubular pull solenoid operating at 12 volts DC, in the preferred embodiment. Power to activate solenoid 60 may come from either the automobile electrical system or a dedicated 12 volt power source. In one embodiment, solenoid 60 is Part No. 62F3663 distributed by Newark Electronics of Los Angeles, Calif.

FIGS. 4, 5 and 6 illustrate cross-sectional views of lock mechanism 24 along cross-sectional line A—A. In each of FIGS. 4, 5 and 6, cam 46 is shown to fit within select mechanism 52 and solenoid 60 is shown to fit within bore 67 of locking mechanism 24. Four extensions 82 through 88 appear at the sides of cam 46 on the end closest to deadbolt 26. On the end of cam 46 opposite extensions 82 through 88, appear eight saw-toothed notches 90 through 104. Saw-toothed notches 90 through 104 are closest to the spring 44. Select mechanism 52 for cam 46 includes four full-length grooves or cam slots 68, 72, 77, and 81 that cam extensions 82 through 88 engage, and four notches 65, 70, 75, and 78. Select mechanism 52 has a collar shape and fits within pathway 32 to select the extent of reciprocating movement of cam 46.

FIG. 8 more particularly illustrates the construction of cam 46 and its engagement of select mechanism 52. Full-length grooves 68, 72, 77, and 81 of select mechanism permit full travel of cam 46 to the locked position 34 that FIG. 1 shows. Adjacent to these full-length grooves appear notches 65, 70, 75, and 78 that limit the movement of cam 46 to the unlocked position 106 of FIG. 3. Operation of cam 46 and select mechanism 52 is described below and is in certain respects conceptually similar to the operation of a retractable ball-point pen.

Figure 9:
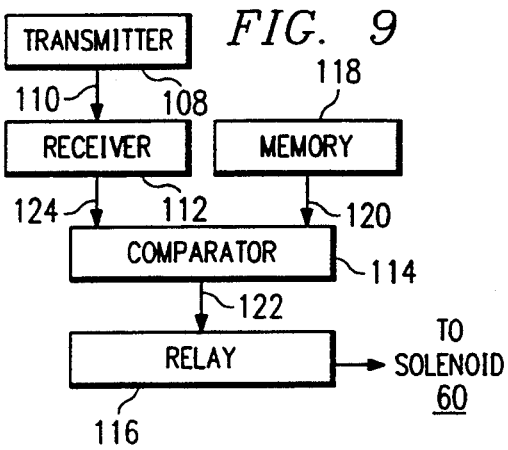
FIG. 9 is a block diagram of the transmitter circuit of a preferred embodiment of the present invention.

FIG. 9 illustrates a schematic block diagram of a circuit in the present invention that permits remote control of car deadbolt lock 10. Transmitter 108 generates a signal 110 to receiver 112. Transmitter 108 may be a key chain radio transmitter having several different radio frequencies and a transmission range of between 30 and 100 feet, depending upon the environmental circumstances. Receiver 112 is associated to receive the particular frequency of transmitter 108. Comparator 114 compares received signal 124 to the memory signal 120 from memory/circuit 118 and, if a match exists, directs an actuation signal 122 to relay 116. In response to receiving the signal, relay 116 directs a 12 volt DC pulse to solenoid 60.

Figure 10:
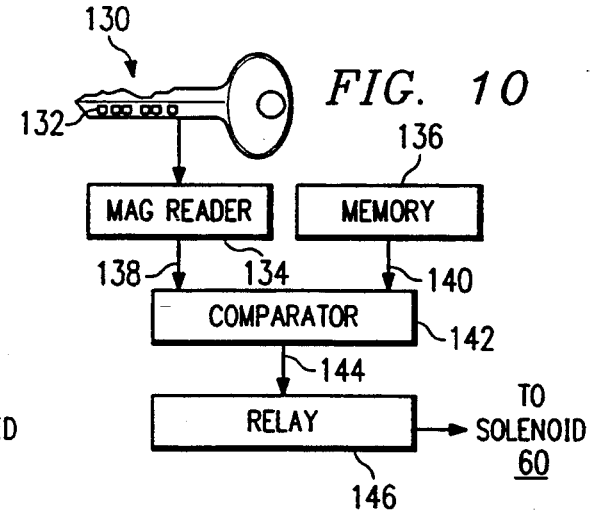
FIG. 10 provides a block diagram of the transmitter circuit of an alternative embodiment of the present invention.
Figure 10A:
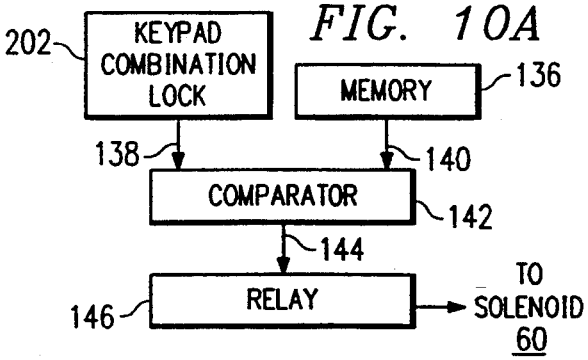
FIG. 10A is a block diagram of the transmitter circuit of another alternative embodiment of the present invention.

FIG. 10 illustrates a schematic block diagram of an alternative circuit in the present invention that provides control of car deadbolt lock 10 when used in conjunction with, but mechanically separate, from the traditional car door lock and key. Key 130 is a traditional car door key with the addition of a magnetic strip 132 embedded within the standard, mechanical key. Therefore the key operates two mechanisms simultaneously, the standard car lock with the notched key and the deadbolt lock with the magnetic strip 132. Magnetic strip reader 134 reads the pulses generated by the magnetic strip 132 as the key 130 is inserted into the lock. Comparator 142 compares received code 138 from the mag reader 134 to the coded signal 140 stored in the memory circuit 136. In response to receiving the signal, relay 146 directs a 12 volt DC pulse, having approximately 1.0 second duration, to solenoid 60.

Magnetic reader 134 is located within the standard key lock mechanism found on most cars while the remainder of the circuitry may be positioned in the car dashboard or the fire wall of the car, near the engine. The key 130 is carried by the car owner. The memory 136, comparator 142, and relay 146 may all be placed in a modular unit approximately 3"×4"×1½" to fit beneath the dashboard.

In the preferred embodiment, the transmission and reception of the coded signals for solenoid actuation use radio frequency transmission. Optional methods of activating the solenoid in the preferred embodiment may include mechanical switches contained within the key lock, magnetic switches within the key lock, pulsed infrared transmitters/receiver pairs, or a combination keypad located outside of the car.

Receiver 112 may be positioned in the car dashboard or the fire wall of the car, near the engine. The receiver 112, memory 118, comparator 114, and relay 116 may all be placed in a modular unit approximately 3"×4"×1½" to fit beneath the dash board. The preferred embodiment is an off-the-shelf item manufactured by Steel Stopper Division of Directed Electronics, Inc., 1413 Linda Vista Drive, San Marcos, Calif. 92069.

Operation of the Preferred Embodiment

Operation of locking mechanism 24 may, for example, begin with the locking mechanism 24 in the positions of FIGS. 1 and 4. Upon receipt of an electrical signal from relay switch 116, solenoid 60 energizes, causing solenoid stem 56 to pull into solenoid barrel 58. This causes lever 42 to rotate at pivot point 66 and withdraw bolt carrier assembly 74 and, hence, deadbolt 26 from receiver assembly 12 into lock housing 14. FIGS. 2 and 5 show that full movement of the solenoid stem 56 into solenoid barrel 58 causes lever 42 to retract the bolt carrier assembly 74 into the intermediate position 36, thereby causing saw-tooth notches 90 through 104 of cam 46 to engage teeth 126 within locking mechanism 24.

When saw-tooth notches 90 through 104 engage teeth 126, cam 46 rotates 1/16 of a full rotation. Upon deactivation of the solenoid 60, FIGS. 3 and 6 show that spring 44 forces bolt carrier assembly 74, including cam 46, in the direction of receiver assembly 12, causing cam 46 to engage select mechanism 52. Upon extensions 82–88 engaging full-length slots 68, 72, 77 and 81 or notches 65, 70, 75 and 78, depending upon the orientation of cam 46 and extensions 82 through 88, cam 46 will be turned yet another 1/16 of a complete revolution. In other words, to provide a full one-eighth of a complete revolution, or 45 degrees of rotation, of cam 46, it is necessary for cam 46 to engage both the teeth 126 within locking mechanism 24 and the full-length slots 68, 72, 77 and 81 or notches 65, 70, 75 and 78. Saw-tooth grooves 126 provide the first 22.5 degrees of rotation as cam 46 engages them. This occurs when solenoid 60 pulls down. As solenoid 60 releases, cam 46 moves to engage sloped edges 161 of full-length slots 68, 72, 77 and 81 or notches 65, 70, 75 and 78 and moves the remaining 22.5 degrees of rotation. Depending on the starting position of extensions 82–88 of cam 46, cam 46 will either be stopped by select mechanism 52 at the unlocked position 106 (see FIG. 3) or permitted to move fully to the locked position 34 (FIG. 1). As a result, with each cycle of solenoid 60 and spring 44, cam 46 will rotate ⅛ of a complete revolution.

In other words, if deadbolt 26 is originally in the locked position 34 (FIGS. 1 and 4), withdrawal of cam 46 (FIGS. 2 and 5) rotates cam 46 1/16 of a turn. Subsequent release of solenoid stem 56 causes compression spring 44 to press against bolt carrier assembly 74 resulting in extensions 82–88 of cam 46 engaging notches 65, 70, 75 and 78 of select mechanism 52 thus rotating bolt carrier assembly 74 into the unlocked position 106 (FIGS. 3 and 6).

Figure 11:
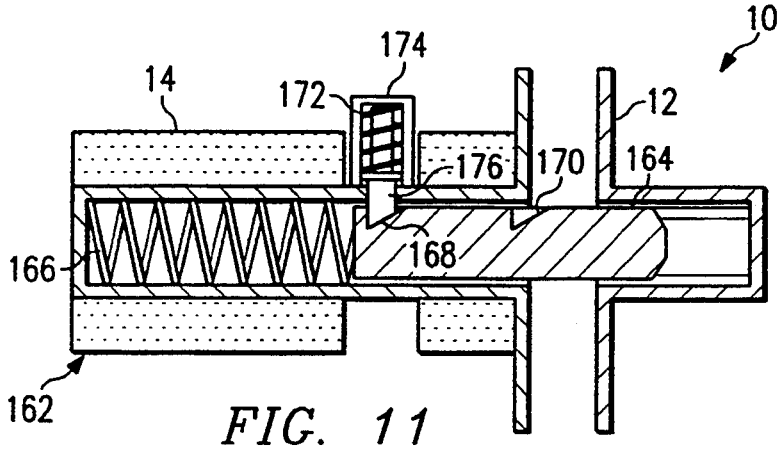
FIGS 11 and 12 illustrate operation of an alternative embodiment of the present invention in the locked and unlocked positions.
Figure 12:
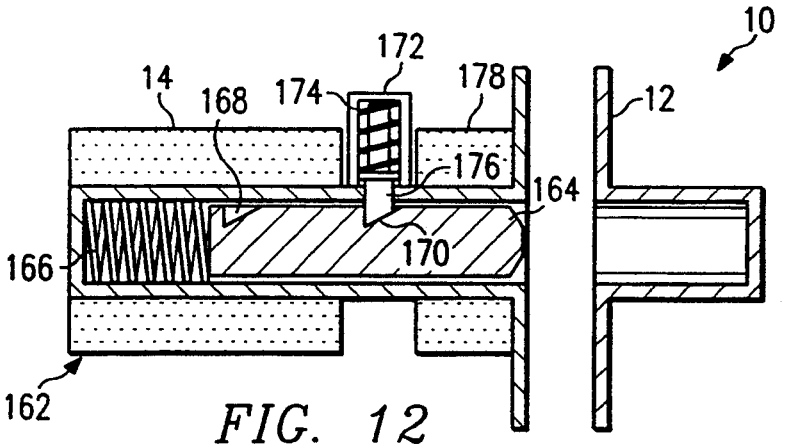

FIGS. 11 and 12 illustrate an alternative embodiment of the present invention. Main solenoid 162 uses deadbolt-solenoid stem 164. Spring 166 pushes deadbolt-solenoid stem 164 in the direction of receiver assembly 12. Deadbolt-solenoid stem 164 includes notches 168 and 170 which prevent movement in the direction of receiver assembly 12. Spring 172, within vertical solenoid 174 exerts tension on the vertical stem 176, causing it to engage one of notches 168 and 170.

To operate the lock 10 of the alternative embodiment, the user may actuate solenoid 162. This causes solenoid 162 to withdraw deadbolt-solenoid stem 164 to the unlocked position 178. In unlocked position 178, vertical stem 176 will engage notch 170. Upon removal of actuation signal from solenoid 162, vertical stem 176 causes deadbolt-solenoid stem 164 to remain in the unlocked position. To lock car deadbolt lock 10 of the alternative embodiment, the use actuates vertical solenoid 174. This causes vertical solenoid stem 176 to overcome the force of spring 172 and withdraw from notch 170 and into vertical solenoid 174. This causes spring 166 to force deadbolt-solenoid stem 164 into receiver assembly 12, thus locking the deadbolt lock 10.

Upon removal of vertical solenoid 174 actuation power, vertical stem 176 is again pressed downward from vertical spring 172 to engage notch 168. This assures that deadbolt-solenoid stem 164 does not exit solenoid 162 when receiver assembly 12 is not present to stop it (for example,2 when the lock is actuated with the car door open for solenoid testing or otherwise).

The materials for the embodiment of FIGS. 11 and 12 are similar to those of the preferred embodiment, many of the strength considerations and other considerations are the same. The preferred embodiment however, has additional simplicity and fewer moving parts to provide enhanced component reliability. This alternative embodiment may increase the cost and complexity of the lock. The configuration of the embodiment of FIGS. 11 and 12, although different, satisfies the objectives of the present invention of providing a car deadbolt lock 10 that permits remote control, and that is not associated with the mechanical portion of the car door.

Figure 13:
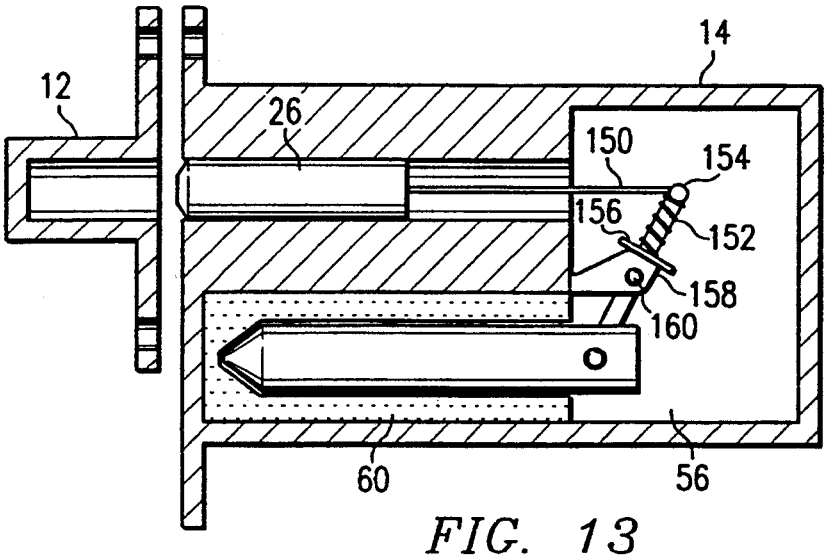
FIG. 13 is yet another alternative embodiment of the present invention.

FIG. 13 illustrates yet another alternative embodiment of the present invention. This design uses the same remote actuator, receiver assembly 12, lock housing 14 and solenoid 60. A significant difference between the preferred embodiment and the FIG. 13 embodiment is the method of keeping deadbolt 26 in the locked and unlocked positions.

The embodiment of FIG. 13 replaces cable 38 with a solid rod 150. Spring 152 attaches around actuator 154 on top of washer 156. Pivot cam 158 allows lever 154 to pivot at point 160 and holds spring 154 and washer 156 in place.

Operation of the FIG. 13 alternative embodiment is also similar to that of the preferred embodiment. In the unlocked position, spring tension against cam-pivot point 160 prevents movement until solenoid 60 is actuated. Once actuated, solenoid 60 pushes solenoid stem 56 out to cause lever 154 to reciprocate. This overcomes force of spring 152 to move bolt 26 to the locked position. Opening the alternative embodiment of FIG. 13 follows the reverse procedure.

Various modifications of these disclosed embodiments, as well as alternative embodiments to the invention will become apparent to persons skilled in the art upon reference to the above description. It is, therefore, contemplated that the appended claims will cover such modifications that fall within the true scope of the invention.

What is claimed is:

1. A car deadbolt lock for locking a car door, comprising:
- a lock housing mountable within said car door and adjacent to a car door facing; and
- a locking mechanism within said lock housing, said locking mechanism comprising,
  - a deadbolt mounted to reciprocate between a locked position and an unlocked position,
  - a solenoid,
  - a spring actuator,
  - a cam member, and
  - a select mechanism having a plurality of teeth and grooves,
  - wherein said spring actuator controls the unlocked and locked condition of the lock,
  - wherein said select mechanism causes said deadbolt and said cam member to rotate about a longitudinal axis and reciprocate between said locked and said unlocked positions, and
  - wherein when said deadbolt and said cam member move in response to an electrical signal, a toothed portion on said cam member engages said plurality of teeth of said select mechanism and a projection on said cam member engages one of said plurality of grooves of said select mechanism.

2. The apparatus of claim 1, further comprising a receiver assembly mountable within said car facing for receiving said deadbolt when said deadbolt is in said locked position, thereby causing said deadbolt to lock the car door to said facing.

3. The apparatus of claim 2, wherein said receiver assembly comprises a hollow tube formed of high tensile material for receiving said deadbolt.

4. The apparatus of claim 3, wherein said hollow tube comprises an inner surface of high tensile material for receiving said deadbolt.

5. The apparatus of claim 1, further comprising circuitry for directing said electrical signal to said solenoid.

6. The apparatus of claim 5, wherein said circuitry for directing said electrical signal comprises a remote actuator for remotely controlling the position of said locking mechanism between said locked and said unlocked positions.

7. The apparatus of claim 6, wherein said remote actuator comprises a pulsed radio frequency transmitter/receiver pair.

8. The apparatus of claim 6, wherein said remote actuator comprises a pulsed infrared transmitter/-receiver pair.

9. The apparatus of claim 5 wherein said circuitry comprises a plurality of magnetic switches associated with the car door key lock, but disassociated with mechanical actuation of the car door key lock.

10. The apparatus of claim 5 wherein said circuitry comprises a keypad including a plurality of electronic switches associated with the car door key lock, but disassociated with the mechanical actuation of the car door key lock.

11. The apparatus of claim 5, wherein said circuitry comprises a combination lock/switch for directing said electrical signal to said solenoid.

12. The apparatus of claim 1 wherein said lock housing is a self-contained unit, thereby preventing access to said locking mechanism.

13. The apparatus of claim 1, wherein said lock housing comprises a light high tensile material cover for preventing access to said locking mechanism.

14. The apparatus of claim 13, wherein said lock housing comprises a light high tensile plastic cover.

15. The apparatus of claim 1, wherein said locking mechanism comprises a bolt carrier for supporting said deadbolt, said bolt carrier housing said select mechanism.

* * * * *